US008126168B2

(12) United States Patent
Hibbing

(10) Patent No.: US 8,126,168 B2
(45) Date of Patent: Feb. 28, 2012

(54) CAPACITIVE SOUND TRANSDUCER HAVING A PERFORATED ATTENUATION DISK

(75) Inventor: Manfred Hibbing, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 952 days.

(21) Appl. No.: 11/992,025

(22) PCT Filed: Sep. 12, 2006

(86) PCT No.: PCT/EP2006/008865

§ 371 (c)(1),
(2), (4) Date: May 21, 2008

(87) PCT Pub. No.: WO2007/031270

PCT Pub. Date: Mar. 22, 2007

(65) Prior Publication Data

US 2010/0061572 A1 Mar. 11, 2010

(30) Foreign Application Priority Data

Sep. 14, 2005 (DE) ..... 10 2005 043 664

(51) Int. Cl.
*H04R 25/00* (2006.01)

(52) U.S. Cl. ..... 381/174; 381/399; 381/424

(58) Field of Classification Search ..... 381/174, 381/399, 424
See application file for complete search history.

(56) References Cited

U.S. PATENT DOCUMENTS

| | | | | |
|---|---|---|---|---|
| 3,418,436 | A | 12/1968 | Neumann | |
| 4,817,168 | A | 3/1989 | Fidi | |
| 5,883,779 | A * | 3/1999 | Catanescu et al. | 361/283.1 |
| 2006/0141656 | A1 * | 6/2006 | Dehe et al. | 438/48 |
| 2007/0274545 | A1 * | 11/2007 | Nakaya et al. | 381/191 |

FOREIGN PATENT DOCUMENTS

| | | |
|---|---|---|
| DE | 821 217 | 11/1951 |
| DE | 856 615 | 11/1952 |
| DE | 1 714 870 | 1/1956 |
| DE | 2 320 811 | 11/1973 |
| DE | 197 15 365 | 10/1998 |
| GB | 921818 | 3/1963 |
| JP | 50-11516 | 2/1974 |

OTHER PUBLICATIONS

"Kondensatormikrofone mit Hochfrequenzschaltung, Sennheiser RF Condenser Microphones MKH", Berlin, Mar. 2001.

* cited by examiner

*Primary Examiner* — Phuc Dang
(74) *Attorney, Agent, or Firm* — Frommer Lawrence & Haug LLP

(57) ABSTRACT

A capacitive sound transducer provided with a perforated attenuation disk. The invention further relates to a capacitive sound transducer and a condenser microphone having such a sound transducer. The sound transducer comprises a diaphragm and a counterelectrode which is disposed at a short distance from the diaphragm and provided with first perforations. In order to attenuate natural oscillations of the diaphragm at high frequencies, a capacitive sound transducer is proposed in which a sound-permeable attenuation disk provided with second perforations is disposed at a short distance from the diaphragm and opposite the counterelectrode. In this arrangement, the first perforations and the second perforations are also offset in relation to each other.

13 Claims, 5 Drawing Sheets

CAPACITIVE SOUND TRANSDUCER HAVING A PERFORATED ATTENUATION DISK

CROSS-REFERENCE TO RELATED APPLICATIONS

Figure 1:
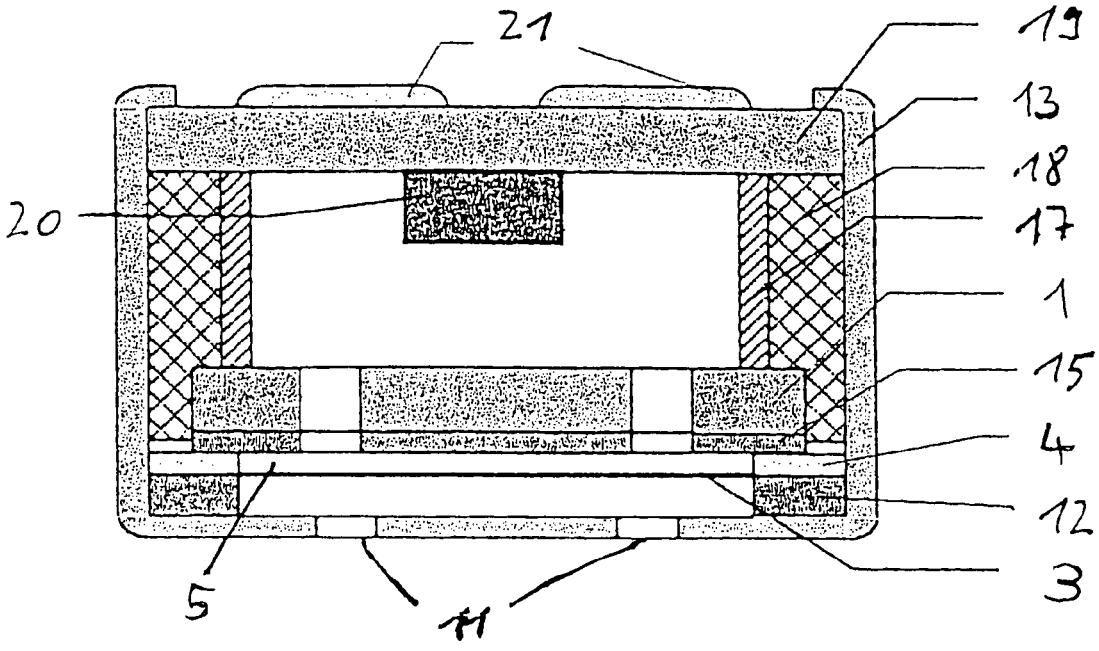

This is a national phase application of International Application No. PCT/EP2006/008865, filed Sep. 12, 2006 which claims priority of German Application No. 10 2005 043 664.1, filed Sep. 14, 2005, the complete disclosures of which are hereby incorporated by reference.

BACKGROUND OF THE INVENTION a) Field of the Invention

The invention relates to a capacitive sound transducer comprising a diaphragm and a counterelectrode which is disposed at a short distance from the diaphragm and provided with first perforations. The invention further relates to a condenser microphone provided with a capacitive sound transducer according to the invention.

b) Description of the Related Art

A capacitive sound transducer of a condenser microphone contains a planar diaphragm which is moved by sound, and a perforated counterelectrode parallel thereto at a short distance therefrom. The diaphragm and counterelectrode are designed to be electrically conductive and form an electrical capacitor whose capacitance is dependent on the diaphragm deflection caused by the sound. Such a condenser microphone is known form DE 19715365, for example.

Due to the viscosity of the air, the narrow, air-filled space between the diaphragm and the counterelectrode, called the air gap, acts as a frictional resistance which inhibits movement of the diaphragm. This effect is used to control the movement of the diaphragm. However, the air gap resistance is not constant, but depends on the momentary distance between the diaphragm and the counterelectrode. When the diaphragm moves towards the counterelectrode, the air gap narrows, and as a result the frictional resistance becomes greater, otherwise smaller. For this reason, any over-pressure in front of the diaphragm that moves the diaphragm towards the counterelectrode will generate a smaller diaphragm deflection than an equally large under-pressure that moves the diaphragm away from the counterelectrode. For this reason, the movement of the diaphragm and the change in capacitance produced as a result is not a linear copy of the sound signal, but is nonlinearly distorted.

The degree of nonlinearity can be reduced by decreasing the diaphragm deflection by means of suitable measures, for example by stronger air-gap attenuation. However, this gives rise to disadvantageous effects because the transducer sensitivity is reduced, as a result of which the noise characteristics of the microphone are also detrimentally affected.

One advantageous option for reducing the nonlinearity of the diaphragm deflection is provided by the "symmetrical push-pull converter", as described in DE 43 07 825 A1, for example. It contains a second counterelectrode with properties identical to those of the first counterelectrode and which is disposed in front of the diaphragm in such a way that similar air gaps are formed on both sides of the diaphragm. In this case, the movement of the diaphragm causes opposite changes in resistance in the two air gaps, which mutually compensate each other. By this means, the movement of the diaphragm is linearized and the transducer distortions are minimized.

In push-pull converters, the change in capacitance between the two counterelectrodes and the diaphragm is generally evaluated by applying the HF principle, by connecting both counterelectrodes to the electric circuit of the microphone. The disadvantage this involves, namely that the additional counterelectrode disposed in front of the diaphragm is directly exposed to humidity, with the result that its electrical insulation can be weakened, does not have an effect when the HF principle is applied, because said principle results in very low electrical impedances.

In the case of condenser microphones and electret microphones operating according to the NF principle, electrical operation of the front counterelectrode would then lead to substantially greater moisture sensitivity due to the very high electrical impedances that then arise. Until now, this disadvantage has stood in the way of the push-pull principle being applied to these types of microphone.

Another disadvantage of the capacitive sound transducers used in known condenser microphones is that, in those regions lying opposite the perforated regions of the counterelectrode, the diaphragm produces partial natural oscillations at high frequencies, and these oscillations lead to undesired, frequency-dependent changes in the transmission characteristics of the condenser microphone. The frequencies at which partial oscillations occur are dependent on the mechanical tension of the diaphragm and on the size and shape of the counterelectrode perforations. In many cases, they are within the frequency transmission range, that is the specified operating frequency range, and lead to undesired frequency-dependent changes in the transmission characteristics of the condenser microphone.

This undesired oscillation behavior at high frequencies can be sufficiently suppressed in those regions of the diaphragm which lie opposite the non-perforated regions of the counterelectrodes, if the distance between the diaphragm and the counterelectrode is made so small that the viscosity of the air in the air gap formed by the diaphragm and the counterelectrode ensures sufficient attenuation of diaphragm movements. However, this attenuation is absent in those diaphragm regions which lie opposite the counterelectrode, with the consequence that the undesired natural oscillations of the diaphragm are not suppressed.

Known methods for attenuating diaphragm movements, for example by means of a porous layer of fabric attached to the rear side of the counterelectrode, are unable to achieve sufficient attenuation of the partial oscillations because, at high frequencies; sufficiently direct action is prevented by the acoustic resilience of the air trapped in the perforated regions of the counterelectrode.

U.S. Pat. No. 4,817,168 discloses a directional microphone in the form of a condenser microphone, in which a diaphragm is arranged at a small distance from a counterelectrode provided with perforations. Said patent also discloses an air chamber which is separated from the counterelectrode and an intermediate wall with openings.

A condenser microphone provided with two conventional diaphragm-counterelectrode systems, which are separated by a solid body with a connecting channel, is known from GB 921,818.

A condenser microphone in which two perforated plates are arranged at a distance from each other with their perforations offset from each other, and which are provided with an attenuation layer is known from DE 821 217.

OBJECT AND SUMMARY OF THE INVENTION

The object of the invention consists in providing a capacitive sound transducer which efficaciously suppresses in a simple manner the nonlinear distortions and interfering partial oscillations of the diaphragm.

The object is achieved according to the invention with a capacitive sound transducer of the kind initially specified by a sound-permeable attenuation disk having second perforations, wherein the first perforations and the second perforations are offset in relation to each other, the diaphragm is arranged between the counterelectrode and the attenuation disk, and the distance between the attenuation disk and the diaphragm is substantially equal to the distance between the counterelectrode and the diaphragm.

The invention is based on the realization that, when the distance between the attenuation disk and the diaphragm is small, the undesired partial oscillations of the diaphragm can be efficaciously suppressed in those regions lying opposite the perforated regions of the counterelectrode, i.e. the holes therein, by means of the viscosity of the air trapped between the diaphragm and the additional attenuation disk. In order to exploit this effect, the second perforations are offset in such a way that perforated regions of the first and second perforations do not overlap, or only partially. The perforations of the counterelectrode and the attenuation disk can be embodied in any way desired, not only with regard to the arrangement of the perforated regions, i.e. of the holes, but also with regard to their size, quantity and shape.

Every diaphragm essentially has modes. The frequencies of the modes at which the diaphragm as a whole resonates are so low that the associated wavelengths are so large in comparison to the perforation structure of the counterelectrode that the discontinuities in the air gap in the perforated regions produce only a gradual reduction of the total attenuation. At the high frequencies of the partial modes, in contrast, the ratios are fundamentally different. The regions of the diaphragm lying opposite the perforated regions of the counterelectrode are comparable with partial diaphragms that are mounted on the perforation edge. The partial diaphragms can oscillate freely and relatively unattenuated in the hole region. All that remains is the internal attenuation of the diaphragm material and the influence of the surrounding air gap region, but this influence is hardly able to affect the perforated region via the low bending stiffness of the diaphragm.

At the lowest partial oscillation (base mode), the partial diaphragm oscillates most strongly in the middle, where the attenuating effect must therefore be greatest. According to the invention, this is achieved by attenuating at least the middle region of the partial diaphragm by means of at least one air gap. In the edge region of the partial diaphragm, the perforations of the counterelectrode and the attenuation disk may partially overlap without substantially impairing the attenuation effect. As a possible guideline for sufficient attenuation, at least half the partial diaphragm should be covered by at least one air gap.

Additional partial oscillation modes at even higher frequencies are usually so weak that there is no particular need to take them into consideration in this context.

By means of the sound-permeable perforated attenuation disk according to the invention, the other acoustic properties of the capacitive sound transducer are only minimally affected, whereas the natural oscillations of the diaphragm and distortions of diaphragm movement are efficaciously suppressed, which leads to clearly improved transmission quality of the transducer, particularly at high frequencies. Due to the placement of the attenuation disk of the invention, a level of attenuation is achieved that acts locally and directly in those regions of the diaphragm where partial oscillations tend to occur. The local and direct effect is achieved by directly exploiting the viscosity of the air located between the diaphragm and the attenuation disk for attenuation, i.e. without any additional mechanical or acoustic coupling elements.

If the distance between the diaphragm and the counterelectrode, on the one hand, and between the diaphragm and the attenuation disk, on the other hand, is small enough, a sufficiently strong attenuation effect distributed as uniformly as possible over the diaphragm can also be achieved, even when the perforated regions of the counterelectrode and the attenuation disk partially overlap.

This arrangement is also particularly advantageous, since the attenuation disk ensures, whatever the diaphragm deflection, that there is a contrary change in the acoustic impedances in the two air gaps, with the result that the total acoustic impedance of the capacitive sound transducer of the invention is less dependent on the diaphragm deflection than is the case in conventional capacitive sound transducers. The natural oscillations and the nonlinear distortions are thus weakened in a simple manner, without impairing the other properties of the capacitive sound transducer.

The capacitive sound transducer of the invention permits a uniform frequency response at high frequencies. Frequency response is one of the most important transducer characteristics that it is possible to document. For the user of a capacitive sound transducer of the invention, an improvement can be seen immediately, and is manifested in a direct and positive manner in the transmission quality.

The attenuation disk of the invention requires only a minor constructional modification of a capacitive sound transducer, as a result of which the attenuation of interfering influences is made possible in a simple and cost-efficient manner.

Preferred embodiments of the capacitive sound transducer of the invention are also described.

It is advantageous when the first perforations and the second perforations are offset from each other in such a way that perforated regions, i.e. the holes of the counterelectrode, each lie opposite non-perforated regions of the attenuation disk. Each region of the diaphragm is thus faced by at least one attenuating air gap that attenuates the interfering natural oscillations. By arranging the perforations in this way in relation to each other, maximum attenuation of the partial oscillations is achieved.

In another preferred embodiment, the first perforations and the second perforations are offset from each other in such a way that perforated regions of the counterelectrode each lie opposite a part of a perforated region of the attenuation disk. When the perforations are arranged like this in relation to each other, the perforated regions of the counterelectrode and the attenuation disk are partially overlapping. This means there are some regions of the diaphragm that are not opposite a non-perforated region. This is particularly advantageous, since the perforated regions of the first and second perforations can then be arranged so that they lie closer together and are greater in number. That is advantageous, because the sound permeability of the counterelectrode and the attenuation disk is increased as a result, thus improving the efficiency of the transducer at high frequencies.

The first perforations and the second perforations are preferably offset from each other in such a way that perforated regions of the counterelectrode each lie opposite a part of a first perforated region of the attenuation disk and at least one part of a second perforated region of the attenuation disk. In this embodiment, a perforated region of the counterelectrode is overlapped by at least two perforated regions of the attenuation-disk. This permits attenuation according to the invention even in the case where a large number of perforated regions in the first set of perforations is provided, from which a similarly large number of perforated regions in the second set of perforations is offset.

In another particularly advantageous configuration, that part of a perforated region of the attenuation disk which lies opposite the at least one perforated region of the counterelectrode is an edge region of the perforated region of the attenuation disk. In such an arrangement, the holes of the counterelectrode and the attenuation disk partially overlap each other to a slight extent in their edge regions. In this way, a middle region of a partial diaphragm always lies opposite at least one non-perforated region. Such an arrangement allows a compromise to be reached between a maximum attenuation effect (no overlapping of the perforations) and a dense arrangement and/or large number of perforations of the counterelectrode and the attenuation disk (parts of the perforations overlap).

In another configuration, the second set of perforations has regions which are perforated essentially identically to the first set of perforations. In this way, the acoustic properties of the attenuation disk are matched to those of the counterelectrode. For example, the size, shape, quantity and arrangement of the perforated regions, i.e. the holes, are identical, so that by means of a corresponding offset angle between the counterelectrode and the attenuation disk, i.e. by turning the attenuation disk in relation to the counterelectrode about the rotational axis perpendicular to the attenuation-disk, it is possible to achieve efficacious attenuation of the diaphragm, on the one hand, and a degree of symmetry which is favorable for low-distortion movement of the diaphragm, on the other hand.

It is advantageous to arrange perforated regions of various sizes within the first perforations and/or the second perforations. Different hole sizes result in a corresponding distribution of the partial oscillation frequencies. In this way, the resonance effects can be distributed over a greater frequency range, so that they do not occur in concentrated form at one frequency. However, the partial oscillations are still unattenuated without the inventive arrangement of an attenuation disk, and act disadvantageously on the transmission quality with interfering transient oscillations and settling of oscillations. For this reason, it is advantageous, in this case also, to carry out the attenuation according to the invention.

The perforations can be arranged particularly advantageously with rotational symmetry, in the form of circles, in rows or as honeycombs. A rotational symmetry of circular hole arrangements facilitates symmetrical design of the two perforated disks, thus allowing acoustically symmetrical solutions with identical numbers of holes in acoustically equivalent regions of the attenuation disk to be found by simple means. This arrangement is particularly advantageous for realizing a symmetrical push-pull converter. Arranging the perforations in rows or as honeycombs allows a more uniform and close-meshed structure of the perforated regions, which is particularly advantageous. This permits greater acoustic permeability, which has a beneficial effect, particularly at high frequencies.

A particularly preferred embodiment is one in which the attenuation disk is embodied as a second counterelectrode. If an additional counterelectrode is used as attenuation disk, this takes over the attenuating function of the attenuation disk if its perforations are arranged according to the invention. In this way, the advantages of a push-pull converter can be combined with those of the inventive attenuation disk. By offsetting the second perforations of the second counterelectrode in relation to the first perforations of the first counterelectrode, it is possible to suppress interfering influences caused by nonlinearities of diaphragm movement and natural oscillations of the diaphragm in a push-pull converter, so that the latter has significantly improved transmission characteristics in high frequency ranges than has been possible hitherto with a push-pull converter according to the prior art. This embodiment can be used advantageously in conjunction with the HF principle, whereas the embodiment comprising an attenuation disk without electrical function is particularly suitable for condenser microphones that operate according to the NF principle.

In another preferred embodiment, the attenuation disk is not coupled electrically to the sound transducer, and no electrical evaluation occurs. This makes possible a sound transducer of very simple structure, to which only the attenuation disk of the invention needs to be added, without having to make changes to the electrical structure of the transducer.

It is also preferred that the distance between the counterelectrode and the diaphragm be substantially equal to the distance between the attenuation disk- and the diaphragm. By means of this symmetrical arrangement, any diaphragm deflections will lead to acoustic impedances in the two air gaps being changed by the same amount in opposite directions and to the total acoustic impedance of the sound transducer remaining constant. As a result, both the natural oscillations of the diaphragm and the nonlinear distortions of the sound transducer are suppressed.

The invention also relates to a condenser microphone provided with a sound transducer as discussed above.

The invention shall now be described in greater detail with reference to the drawings.

Figure 2A:
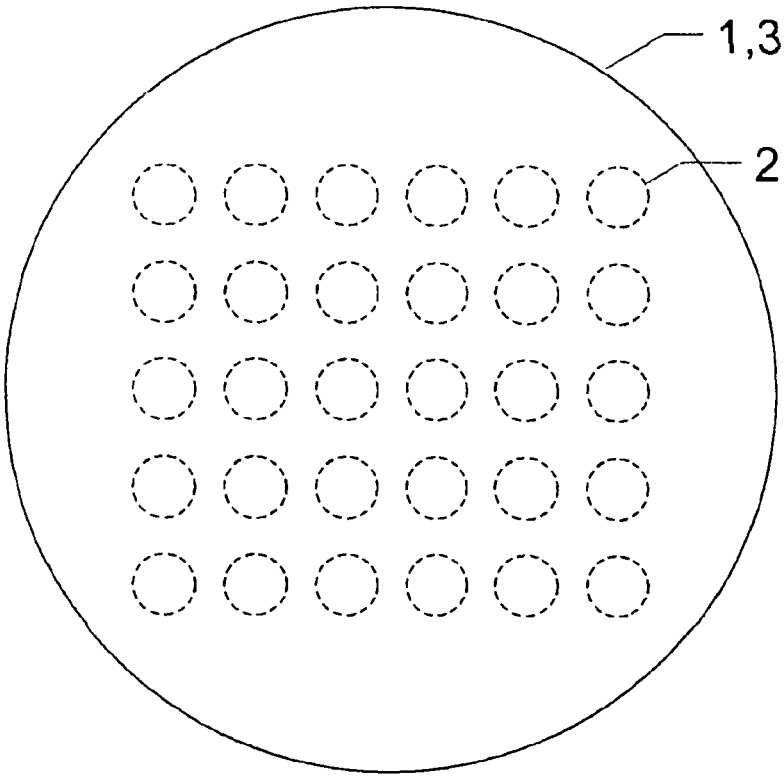
Figure 2B:
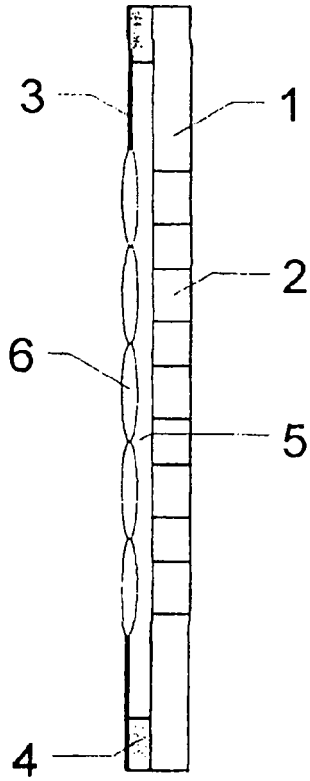
Figure 3A:
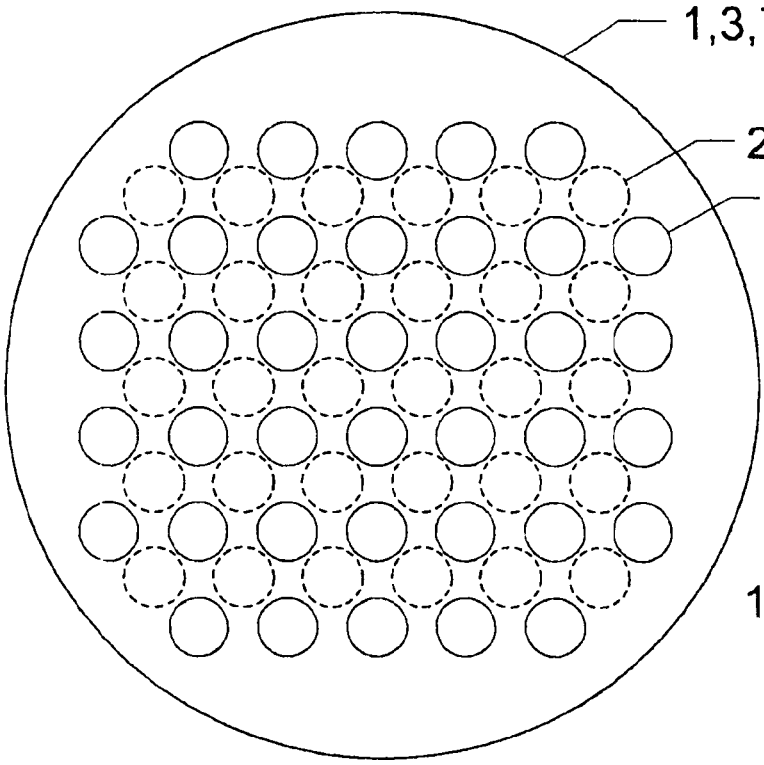
Figure 3B:
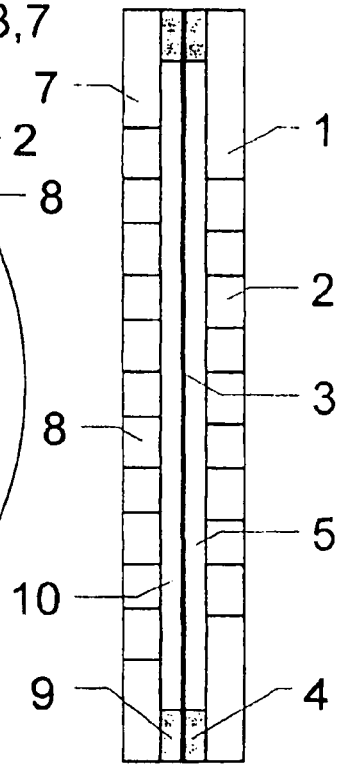
Figure 4:
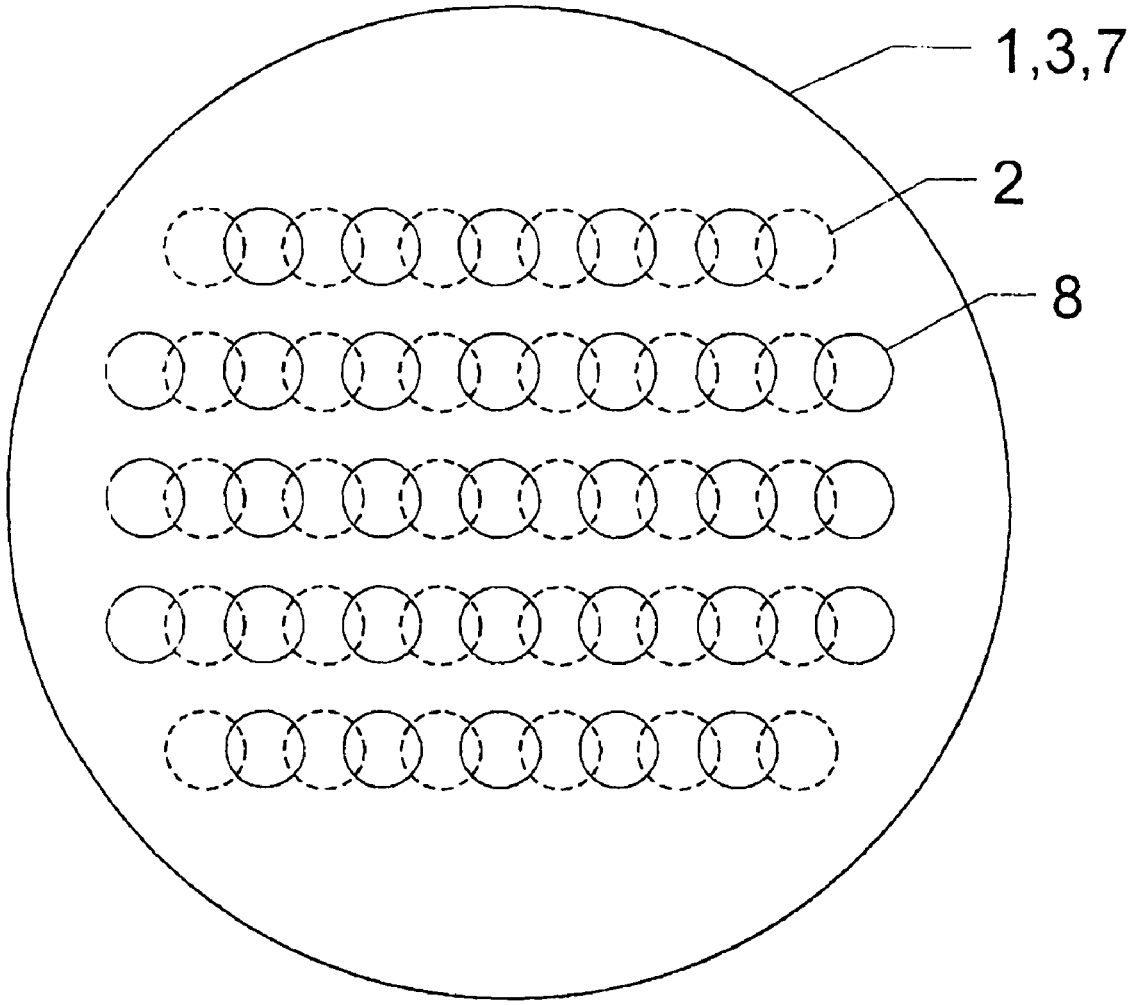
Figure 5:
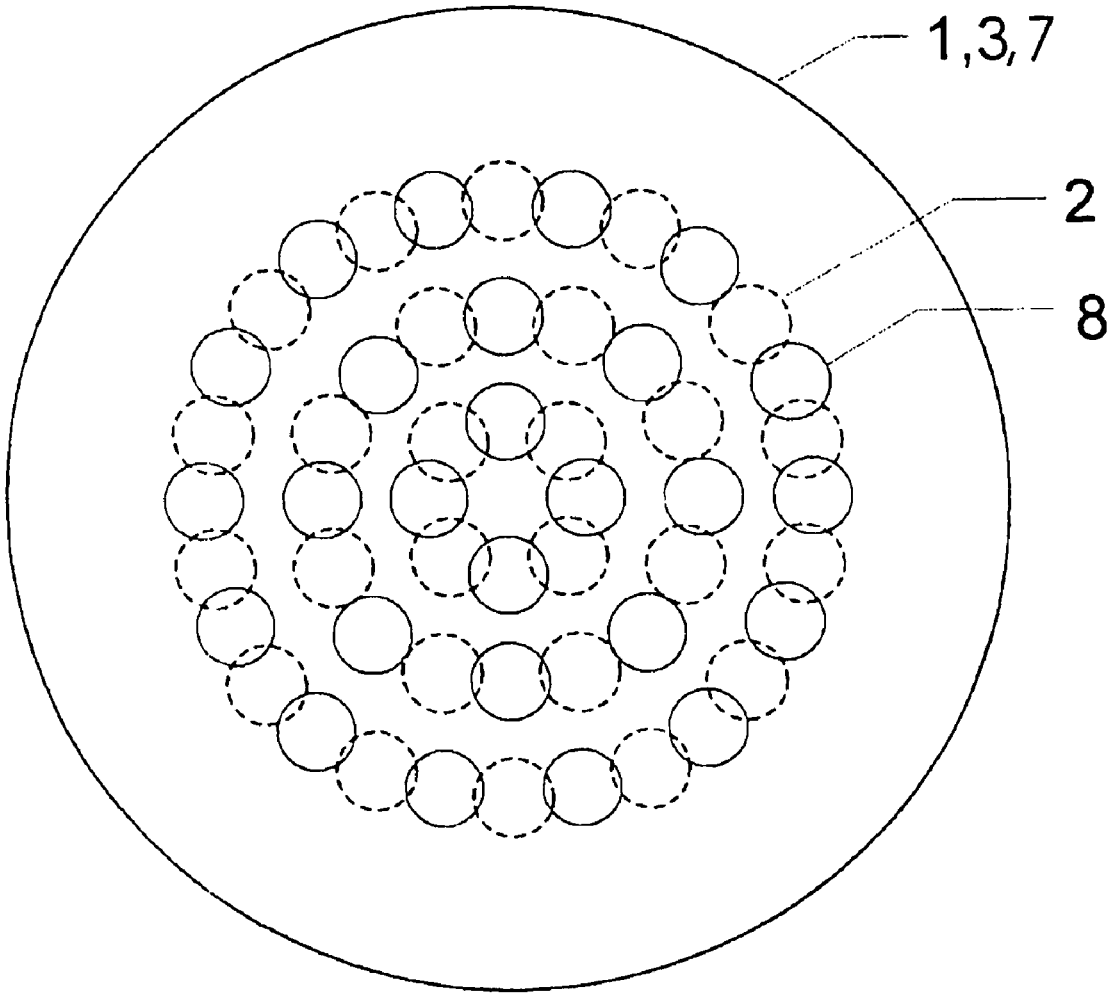

In the drawings:

FIG. 1 shows a schematic view of a known condenser microphone provided with a capacitive sound transducer;

FIG. 2*a* shows a plan view of a diaphragm in a known capacitive sound transducer;

FIG. 2*b* shows a cross-section through a diaphragm and a counterelectrode in a known capacitive sound transducer;

FIG. 3*a* shows a plan view of an attenuation disk in the capacitive sound transducer of the invention, according to a first embodiment of the invention;

FIG. 3*b* shows a cross-section through an attenuation disk, diaphragm and counterelectrode in the capacitive sound transducer of the invention, according to a first embodiment of the invention;

FIG. 4 shows a second embodiment in a plan view of an attenuation disk in the sound transducer of the invention; and FIG. 5 shows a third embodiment in a plan view of an attenuation disk-in the sound transducer of the invention.

DESCRIPTION OF THE PREFERRED EMBODIMENTS

FIG. 1 shows a cross-section through a known condenser microphone (electret microphone) provided with a capacitive sound transducer, of the kind produced in large numbers in similar or identical form. Inside the microphone housing 13, which has an inlet opening 11 for sound, the following elements are provided: a diaphragm ring 12, a diaphragm 3 glued onto the diaphragm ring 12, a spacer 4, an electret film 15, a counterelectrode 1 connected thereto, a contact ring 17, an insulation member 18 and a circuit board 19 with a circuit arrangement 20 provided thereon (in particular with a field-effect transistor) and with terminal contacts 21. The air gap 5 between the diaphragm 3 and the electret film 15 or counterelectrode 1 is defined by the spacer 4.

However, such a design has disadvantages, with the result that such a condenser microphone is not particularly suitable for use as a high-quality microphone. At high frequency ranges, natural oscillations of diaphragm 3 are induced in those regions that do not lie opposite an attenuating air gap of counterelectrode 1. These natural oscillations lead to interfering influences on the transmission behavior of the condenser microphone.

FIG. 2*a* shows a schematic plan view of a diaphragm of a capacitive sound transducer in a conventional condenser microphone; FIG. 2*b* shows a cross-section of the actual capacitive sound transducer. Diaphragm 3 is disposed in front of counterelectrode 1 having perforations 2 (broken lines). The air trapped in the air gap 5 between diaphragm 3 and counterelectrode 1 attenuates the movement of the diaphragm due to the viscosity of the air. However, diaphragm 3 is not sufficiently attenuated in the region of the perforations, so interfering natural oscillations 6 can develop here as a result.

FIG. 3*a* and FIG. 3*b* show, analogously to FIG. 2*a* and FIG. 2*b*, the substantially modified elements of a capacitive sound transducer according to a first embodiment of the invention. An additional attenuation disk 7 having perforations 8 (unbroken lines) is disposed in front of diaphragm 3. The two sets of perforations 2, 8 are offset in relation to each other in such a way that there is nowhere where they overlap. A spacer 9 similar to spacer 4 determines the distance between attenuation disk 7 and diaphragm 3, thus forming an second air gap 10. This results in diaphragm 3 being attenuated over its entire area by an air gap 5 and/or an air gap 10, that is to say, by at least one non-perforated region. In this way, the natural oscillations 6 of diaphragm 3 are efficaciously suppressed.

In the embodiment shown in FIG. 3*a* and FIG. 3*b*, first perforations 2 and second perforations 8 are offset from each other in such a way that perforated regions of the counterelectrode 1 lie opposite non-perforated regions of the attenuation disk 7. The perforated regions of attenuation disk 7 and of counterelectrode 1 are of the same size and shape, but different in number and arrangement in rows.

FIG. 4 shows an example of a second embodiment according to the invention, in which perforation set 8 of attenuation disk-7 partially overlaps perforation set 2 of the counterelectrode 1 and in which perforation sets 2, 8 are arranged in rows. The first perforation set 2 and the second perforation set 8 are offset from each other in such a way that perforated regions of counterelectrode 1 each lie opposite a part of a first perforated region of attenuation disk-7 and at least one part of a second perforated region of attenuation disk-7. In this case also, efficacious attenuation of diaphragm 3 is achieved when the overlap is mainly in the edge regions of the perforations, with the result that sufficiently large attenuating areas of counterelectrode 1 and attenuation disk-7, respectively, particularly in the middle regions of the partial diaphragms, lie opposite the diaphragm, also in the perforated regions of perforation sets 2 and 8.

FIG. 5 shows an example of a third possible embodiment with perforations arranged rotationally symmetrically, in which perforation set 8 of attenuation disk 7 and perforation set 2 of counterelectrode 1 overlap only slightly in the edge regions. The number of holes in counterelectrode 1 and in attenuation disk 7 is the same in each of the three zones shown here by way of example, and the acoustic effect of counterelectrode 1 and attenuation disk 7 is therefore identical. This embodiment is particularly suitable for realizing a symmetrical push-pull converter that combines the advantages of the attenuation disk—of the invention and of a symmetrical push-pull converter.

In FIGS. 2-5, the perforations are shown as circular holes of uniform size, but the perforations may be realized in any other shapes and sizes of perforated regions. The perforations of the two disks may also be differently arranged and/or may differ from each other in number and shape.

The multi-rowed and circular arrangements of holes shown in the Figures signify examples only, and other arrangements of perforated regions may effect equivalent attenuation of the natural oscillations of the diaphragm.

The attenuation disk of the invention can be disposed in a capacitive recording transducer as well as in a capacitive reproduction transducer. In both sound transducers, an attenuation disk according to the invention acts to attenuate and reduce distortion, thus enhancing the signal quality.

Maximum attenuation of the partial vibrations is achieved when a perforated region of the counterelectrode lies opposite a non-perforated region of the attenuation disk. If the perforated regions of the counterelectrode and the attenuation disk overlap, then although the attenuation effect of the partial modes is less, more perforated regions can be accommodated on the counterelectrode and/or the attenuation disk, which leads to an increase in the sound permeability of the counterelectrode and/or the attenuation disk. This means that, for a particular type of capacitive transducer, a compromise can be reached in the number and arrangement of the perforations in relation to each other.

While the foregoing description and drawings represent the present invention, it will be obvious to those skilled in the art that various changes may be made therein without departing from the true spirit and scope of the present invention.

What is claimed is:

1. A capacitive sound transducer comprising:

a diaphragm;

a counterelectrode which is provided with first perforations;

a sound-permeable attenuation disk having second perforations;

said first perforations and second perforations being offset in relation to each other;

said diaphragm being arranged between the counterelectrode and the attenuation disk; and the distance between the attenuation disk and the diaphragm being substantially equal to the distance between the counterelectrode and the diaphragm.

2. The capacitive sound transducer of claim 1, wherein the first perforations and the second perforations are offset from each other in such a way that perforated regions of the counterelectrode lie opposite non-perforated regions of the attenuation disk.

3. The capacitive sound transducer of claim 1, wherein the first perforations and the second perforations are offset from each other in such a way that perforated regions of the counterelectrode each lie opposite a part of a perforated region of the attenuation disk.

4. The capacitive sound transducer of claim 1, wherein the first perforations and the second perforations are offset from each other in such a way that perforated regions of the counterelectrode each lie opposite a part of a first perforated region of the attenuation disk and at least one part of a second perforated region of the attenuation disk.

5. The capacitive sound transducer of claim 3, wherein the part of a perforated region of the attenuation disk is an edge region of the perforated region of the attenuation disk.

6. The capacitive sound transducer of claim 4, wherein the part of a perforated region of the attenuation disk is an edge region of the perforated region of the attenuation disk.

7. The capacitive sound transducer of claim 1, wherein the second perforations has perforated regions that are substantially identical to the first perforations, particularly in respect of shape, size, quantity and arrangement.

8. The capacitive sound transducer of claim 1, wherein perforated regions of various sizes are arranged within the first perforations and/or the second perforations.

9. The capacitive sound transducer claim 1, wherein the perforated regions of at least one set of perforations are arranged in rotational symmetry, in rows or in honeycombs.

10. The capacitive sound transducer of claim 1, wherein the attenuation disk is configured as an additional counterelectrode.

11. The capacitive sound transducer of claim 1, wherein the attenuation disk is not coupled electrically to the sound transducer.

12. The capacitive sound transducer of claim 1, wherein the distance between the counterelectrode and the diaphragm is substantially equal to the distance between the attenuation disk and the diaphragm.

13. A condenser microphone provided with a capacitive sound transducer of claim 1.

* * * * *